US010403968B2

(12) United States Patent
Anderson

(10) Patent No.: US 10,403,968 B2
(45) Date of Patent: Sep. 3, 2019

(54) ANTENNA SYSTEMS AND METHODS FOR INCORPORATING INTO A BODY PANEL

(71) Applicant: TAOGLAS GROUP HOLDINGS LIMITED, Enniscorthy, County Wexford (IE)

(72) Inventor: Christopher M. Anderson, Minneapolis, MN (US)

(73) Assignee: TAOGLAS GROUP HOLDINGS LIMITED, Enniscorthy, County Wexford (IE)

( * ) Notice: Subject to any disclaimer, the term of this patent is extended or adjusted under 35 U.S.C. 154(b) by 224 days.

(21) Appl. No.: 15/467,197

(22) Filed: Mar. 23, 2017

(65) Prior Publication Data

US 2017/0279189 A1 Sep. 28, 2017

Related U.S. Application Data

(60) Provisional application No. 62/313,915, filed on Mar. 28, 2016.

(51) Int. Cl.

| | |
|---|---|
| ***H01Q 1/32*** | (2006.01) |
| ***H01Q 9/04*** | (2006.01) |
| ***H01Q 13/10*** | (2006.01) |
| *H01Q 1/38* | (2006.01) |

(52) U.S. Cl.

CPC ..... *H01Q 1/325* (2013.01); *H01Q 9/0485* (2013.01); *H01Q 13/10* (2013.01); *H01Q 1/38* (2013.01)

(58) Field of Classification Search

CPC ..... H01Q 1/325; H01Q 9/0485; H01Q 13/10; H01Q 1/38

See application file for complete search history.

(56) References Cited

U.S. PATENT DOCUMENTS

| | | | |
|---|---|---|---|
| 2,520,987 | A | 9/1950 | Williams et al. |
| 2,520,988 | A | 9/1950 | Everitt |
| 3,717,876 | A | 2/1973 | Volkers et al. |

(Continued)

FOREIGN PATENT DOCUMENTS

| | | | |
|---|---|---|---|
| DE | 2745475 | A1 | 4/1979 |
| DE | 102017002994 | A1 | 9/2017 |

(Continued)

OTHER PUBLICATIONS

Berger, As Cars Become More Connected, Hiding the Antennas Gets Tougher, New York Times, Mar. 14, 2005.

*Primary Examiner* — Dameon E Levi
*Assistant Examiner* — David E Lotter
(74) *Attorney, Agent, or Firm* — Knobbe, Martens, Olson & Bear, LLP

(57) ABSTRACT

An antenna mountable directly into an aperture in a body panel of, for example, a vehicle is disclosed. The antenna elements can be flat, substantially flat or pre-contoured to match a specific curve of a body panel. As a result the antenna is positionable within a body panel hole or aperture so that the antenna sits flush with the body panel and can be sanded and painted like any other portion of the body panel so that, once painted, the antenna panel is not visibly distinguishable from the body panel. Suitable antennas include, for example, slot radiators and patch antenna. Antennas can be a rigid PCB, a flex PCB, a ceramic element or metal stamping.

17 Claims, 3 Drawing Sheets

(56) References Cited

U.S. PATENT DOCUMENTS

| | | | | |
|---|---|---|---|---|
| 4,229,744 | A | 10/1980 | Luedtke et al. | |
| 4,866,453 | A | 9/1989 | Nagy et al. | |
| 5,532,709 | A | 7/1996 | Talty | |
| 5,812,095 | A | 9/1998 | Adrian et al. | |
| 6,087,996 | A | 7/2000 | Dery | |
| 6,118,410 | A | 9/2000 | Nagy | |
| 6,369,769 | B1 | 4/2002 | Nap et al. | |
| 6,480,170 | B1 | 11/2002 | Langley et al. | |
| 6,509,878 | B1 | 1/2003 | Tornatta et al. | |
| 6,819,294 | B2 | 11/2004 | Raddant | |
| 6,891,515 | B1 | 5/2005 | Langley et al. | |
| 7,847,744 | B2 | 12/2010 | Mierzwa et al. | |
| 8,593,356 | B2 | 11/2013 | Mierzwa et al. | |
| 8,660,511 | B2 | 2/2014 | Talty et al. | |
| 2003/0137463 | A1* | 7/2003 | Shimizu | H01Q 1/241 343/713 |
| 2004/0080459 | A1* | 4/2004 | Marx | H01Q 1/325 343/703 |
| 2004/0150575 | A1 | 8/2004 | Lizalek et al. | |
| 2006/0038729 | A1 | 2/2006 | Ohno et al. | |
| 2007/0001914 | A1 | 1/2007 | Robnett et al. | |
| 2009/0066593 | A1* | 3/2009 | Jared | H01Q 1/1214 343/713 |
| 2011/0050518 | A1* | 3/2011 | Oki | H01Q 1/1214 343/713 |
| 2011/0210895 | A1 | 9/2011 | Buff et al. | |
| 2013/0112837 | A1 | 5/2013 | Spagnolo et al. | |
| 2013/0249748 | A1 | 9/2013 | Togura et al. | |
| 2015/0244067 | A1* | 8/2015 | Nakada | H01Q 1/3275 343/713 |

FOREIGN PATENT DOCUMENTS

| | | | |
|---|---|---|---|
| EP | 1650827 | A2 | 4/2006 |
| GB | 2409344 | A | 6/2005 |
| GB | 2548995 | A | 10/2017 |
| WO | 2005060046 | A2 | 6/2005 |

* cited by examiner

ANTENNA SYSTEMS AND METHODS FOR INCORPORATING INTO A BODY PANEL

CROSS-REFERENCE

This application claims the benefit of U.S. Provisional Application No. 62/313,915, filed Mar. 28, 2016, entitled Antenna Systems and Methods for Incorporating Into A Body Panel which application is incorporated herein by reference.

BACKGROUND

Field

The disclosure relates to a variety of antennas, such as an AM/FM/VHF antennas, which can be incorporated into a body panel for a vehicle, such as a car, truck or boat.

Background

A slot antenna for a motor vehicle results from a looped dielectric slot a horizontal, electrically conducting plane, where the slot has a width of about one quarter inch and a total circumferential length of about one wavelength in the commercial FM broadcasting band of about 3.25 meters. The slot is typically fed at a single point at the front or the side and may be formed in a sheet of conducting material such as a flexible foil sheet attached to the underside of an electrically non-conducting dielectric roof, hood or deck lid or in a painted, electrically conducting sheet coating on the underside of one of the same members. While slot antennas have been useful, newer antennas and frequency bands cannot be easily accommodated with traditional designs. What is needed is a modular antenna system that can be deployed and accommodate a variety of antenna requirements.

SUMMARY

Instead of creating an aperture in a body panel to engage an antenna, an antenna system could employed which is incorporatable into a cut into the structure of a body panel, such as a metal body panel, which results in the body panel becoming part of the antenna.

An antenna can be mounted directly into an aperture in a body panel of, for example, a vehicle. Typically, the antenna would be mounted into a metal body panel. The antenna elements can be flat, substantially flat or pre-contoured to match a specific curve of a body panel. As a result the antenna is positioned within a body panel hole or aperture so that the antenna sits flush with the body panel and can be sanded and painted like any other portion of the body panel so that, once painted, the antenna panel is not visibly distinguishable from the body panel. Suitable antennas include, for example, slot radiators and patch antenna. Antennas can be a rigid PCB, a flex PCB, a ceramic element or metal stamping.

An aspect of the disclosure is directed to systems for incorporating one or more antennas into a body panel. Suitable systems comprise: a body panel having an aperture; an antenna panel having a first side and a second side with a raised body panel mating surface extending from one of the first side and second side wherein the raised body panel mating surface is sized to fit within the aperture in the body panel; an antenna positionable on the antenna panel on an opposing side from the mating panel. Additionally, an antenna panel cap can be provided to secure the antenna panel. The aperture formed in the body panel can be round, oval, ovoid, square, rectangular, triangular, or any other suitable shape. The raised body panel mating surface can be formed from a suitable RF transparent material. Suitable RF transparent material can have controlled thermal expansion properties. Additionally, the one or more antennas can be adhered to the RF transparent material. At least one RF characteristic of the RF transparent material can include material characteristics that allow for tuning or controlling a frequency response of the antenna. Additionally, the RF characteristics can be selected from the group comprising dielectric constant and dielectric loss. in some configurations, at least one RF characteristic of the RF transparent material are controlled by a shape of the aperture. Moreover, an antenna radiation pattern can be controllable by a shape of the aperture. The antenna panel can be configured to snap fits the body panel.

Another aspect of the disclosure is directed to an antenna delivery device. Suitable delivery devices comprise: an antenna panel having a first side and a second side with a raised body panel mating surface extending from one of the first side and second side wherein the raised body panel mating surface is sized to fit within an aperture in a body panel; an antenna positionable on the antenna panel on an opposing side from the mating panel. Additionally, an antenna panel cap can be provided to secure the antenna panel. The aperture formed in the body panel can be round, oval, ovoid, square, rectangular, triangular, or any other suitable shape. The raised body panel mating surface can be formed from a suitable RF transparent material. Suitable RF transparent material can have controlled thermal expansion properties. Additionally, the one or more antennas can be adhered to the RF transparent material. At least one RF characteristic of the RF transparent material can include material characteristics that allow for tuning or controlling a frequency response of the antenna. Additionally, the RF characteristics can be selected from the group comprising dielectric constant and dielectric loss. in some configurations, at least one RF characteristic of the RF transparent material are controlled by a shape of the aperture. Moreover, an antenna radiation pattern can be controllable by a shape of the aperture. The antenna panel can be configured to snap fits the body panel.

Still another aspect of the disclosure is directed to methods of incorporating an antenna into a body panel comprising: providing a body panel having an aperture therethrough; providing an antenna panel having a first side and a second side with a raised body panel mating surface extending from one of the first side and second side wherein the raised body panel mating surface is sized to fit within the aperture in the body panel; positioning an antenna on the antenna panel on an opposing side from the automobile mating panel; and securing the antenna panel to the body panel. Additionally, the methods can include one or more of each of the steps of installing an antenna panel cap, forming the raised body panel mating surface from an RF transparent material with controlled thermal expansion, adhering the antenna to the RF transparent material, selecting the RF transparent material based on at least one RF characteristic which controls a frequency response of the antenna. Additionally, the step of securing can further comprise snap fitting the antenna to the body panel.

Yet another aspect of the disclosure is directed to systems for incorporating one or more antennas into a body panel. Suitable systems comprise: a body panel having an aperture; an antenna panel means having a first side and a second side with a raised body panel mating surface means extending from one of the first side and second side wherein the raised body panel mating surface means is sized to fit within the aperture in the body panel; an antenna positionable on the antenna panel means on an opposing side from the mating panel. Additionally, an antenna panel cap means can be provided to secure the antenna panel. The aperture formed in the body panel can be round, oval, ovoid, square, rectangular, triangular, or any other suitable shape. The raised body panel mating surface means can be formed from a suitable RF transparent material. Suitable RF transparent material can have controlled thermal expansion properties. Additionally, the one or more antennas can be adhered to the RF transparent material. At least one RF characteristic of the RF transparent material can include material characteristics that allow for tuning or controlling a frequency response of the antenna. Additionally, the RF characteristics can be selected from the group comprising dielectric constant and dielectric loss. in some configurations, at least one RF characteristic of the RF transparent material are controlled by a shape of the aperture. Moreover, an antenna radiation pattern can be controllable by a shape of the aperture. The antenna panel means can be configured to snap fits the body panel.

Another aspect of the disclosure is directed to an antenna delivery device. Suitable delivery devices comprise: an antenna panel means having a first side and a second side with a raised body panel mating surface means extending from one of the first side and second side wherein the raised body panel mating surface means is sized to fit within an aperture in a body panel; an antenna positionable on the antenna panel means on an opposing side from the mating panel. Additionally, an antenna panel cap means can be provided to secure the antenna panel. The aperture formed in the body panel can be round, oval, ovoid, square, rectangular, triangular, or any other suitable shape. The raised body panel mating surface means can be formed from a suitable RF transparent material. Suitable RF transparent material can have controlled thermal expansion properties. Additionally, the one or more antennas can be adhered to the RF transparent material. At least one RF characteristic of the RF transparent material can include material characteristics that allow for tuning or controlling a frequency response of the antenna. Additionally, the RF characteristics can be selected from the group comprising dielectric constant and dielectric loss. in some configurations, at least one RF characteristic of the RF transparent material are controlled by a shape of the aperture. Moreover, an antenna radiation pattern can be controllable by a shape of the aperture. The antenna panel means can be configured to snap fits the body panel.

Still another aspect of the disclosure is directed to methods of incorporating an antenna into a body panel comprising: providing a body panel having an aperture therethrough; providing an antenna panel means having a first side and a second side with a raised body panel mating surface means extending from one of the first side and second side wherein the raised body panel mating surface means is sized to fit within the aperture in the body panel; positioning an antenna on the antenna panel means on an opposing side from the automobile mating panel; and securing the antenna panel means to the body panel. Additionally, the methods can include one or more of each of the steps of installing an antenna panel means cap, forming the raised body panel mating surface means from an RF transparent material with controlled thermal expansion, adhering the antenna to the RF transparent material, selecting the RF transparent material based on at least one RF characteristic which controls a frequency response of the antenna. Additionally, the step of securing can further comprise snap fitting the antenna to the body panel.

INCORPORATION BY REFERENCE

All publications, patents, and patent applications mentioned in this specification are herein incorporated by reference to the same extent as if each individual publication, patent, or patent application was specifically and individually indicated to be incorporated by reference. See, for example, DE 2,745,475 A1 published Apr. 12, 1979 to Fischer for Ready-Made Aerial For Motor Vehicle;

U.S. Pat. No. 2,520,987 A issued Sep. 5, 1950 to Williams et al. for Vehicle Body Antenna;

U.S. Pat. No. 2,520,988 A issued Sep. 5, 1950 to Everitt for Car Body Antenna;

U.S. Pat. No. 3,717,876 A issued Feb. 20, 1973 to Willie et al. for Ferrite Antenna Coupled to Radio Frequency Currents in Vehicle Body;

U.S. Pat. No. 4,866,453 A issued Sep. 12, 1989 to Nagy et al. for Vehicle Slot Antenna with Parasitic Slot;

U.S. Pat. No. 5,532,709 A issued Jul. 2, 1996 to Talty for Directional Antenna for Vehicle Entry System;

U.S. Pat. No. 5,812,095 A published Sep. 22, 1998 to Adrian et al. for Mounting Structure for Combined Automotive Trim;

U.S. Pat. No. 6,087,996 A issued Jul. 11, 2000 to Dery for Thin-Film Antenna Device for Use with Remote Vehicle Starting Systems;

U.S. Pat. No. 6,118,410 A issued Sep. 12, 2000 to Nagy for Automobile Roof Antenna Shelf;

U.S. Pat. No. 6,480,170 B1 issued Nov. 12, 2002 to Langley for Patch Antenna;

U.S. Pat. No. 6,819,294 B2 issued Nov. 16, 2004 to Raddant for Vehicle Antenna Device;

U.S. Pat. No. 6,891,515 B1 issued May 10, 2005 to Langley et al. for Multiband Antenna;

U.S. Pat. No. 7,847,744 B2 issued Dec. 7, 2010 to Mierzwa et al. for Apparatus for Mounting a Satellite Antenna in a Vehicle;

U.S. Pat. No. 8,593,356 B2 issued Nov. 26, 2013 to Mierzwa et al. for Apparatus for Mounting a Satellite Antenna in a Trunk of a Vehicle;

U.S. Pat. No. 8,660,511 B2 issued Feb. 25, 2014 to Talty et al. for Antenna Diversity Scheme Employing Band Pass Sampling and Fast Semiconductor Switching;

U.S. 2011/0210895 A1 published Sep. 1, 2011, to Buff for Motor Vehicle Antenna System;

U.S. 2013/0249748 A1 published Sep. 26, 2013 to Togura et al. for Antenna Device and Moving Body Equipped with Antenna Device;

WO 2005/060046 A2 published Jun. 30, 2005 to Callaghan for Concealed Vehicle Antenna Utilizing Body Panel Slot; and BERGER, As Cars Become More Connected, Hiding the Antennas Gets Tougher, New York Times Mar. 14, 2005.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1:
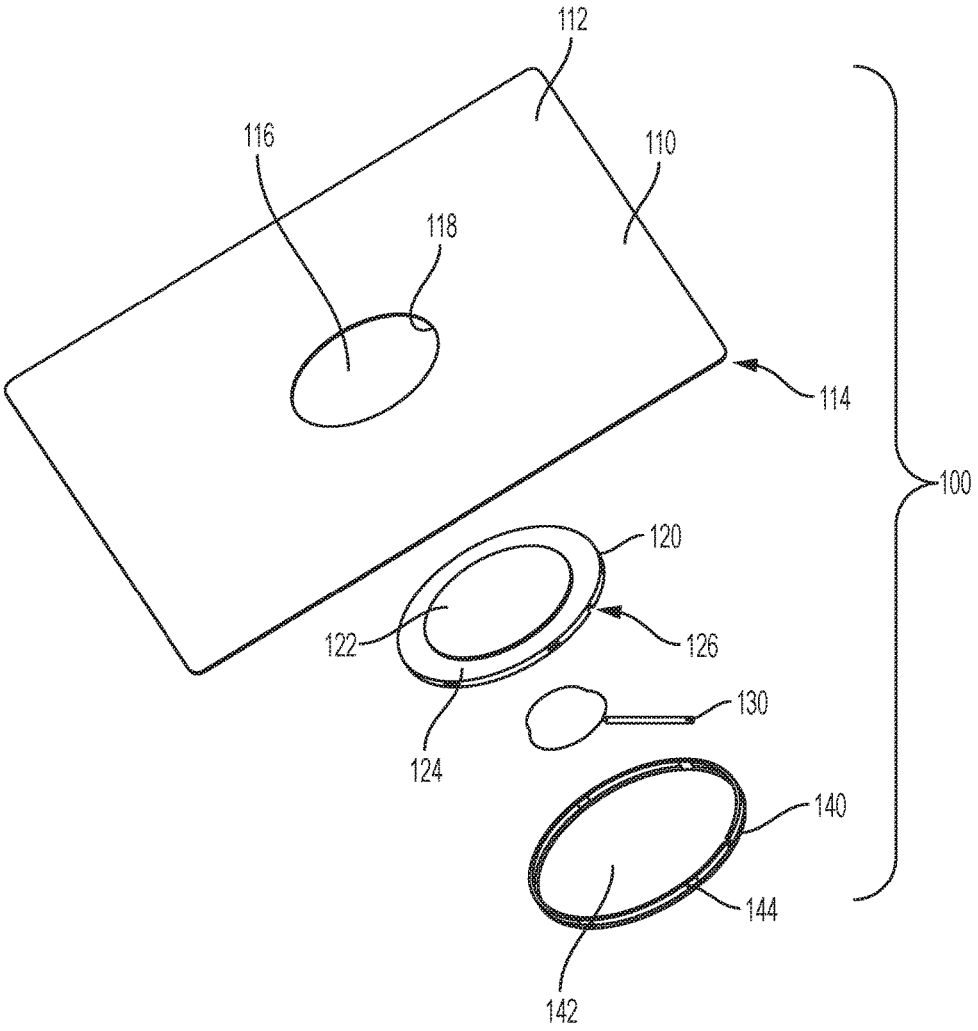
FIG. 1 is an exploded view of an antenna panel configurable to engage a body panel.

FIG. 1 is an exploded view of an antenna panel configurable to engage a body panel. The antenna system 100 engages, for example, an automobile body panel 110. The automobile panel has a first side 112 which faces exteriorly towards the outside of the automobile, and a second side 114 which faces interiorly. An antenna panel 120 is provided which engages one or more antennas 130. Suitable antennas can be, for example, a rigid PCB, a flex PCB, a ceramic element or formed from metal stamping.

The antenna panel 120 engages the automobile body panel 110 such that an raised body panel mating surface 122 will fit within an aperture 116 of the automobile body panel 110. In some configurations, the antenna panel 120 has a single antenna; in other configurations, the antenna panel 120 has more than one antenna. The antennas can be invisible and/or concealed.

The aperture 116 can, in some configurations, be filled with a suitable RF transparent material. The features of the suitable RF transparent material can include thermal expansion. Additionally, the material's RF characteristics (e.g., dielectric constant and dielectric loss) can be selected to optimize control and facilitate tuning the antenna's frequency response and efficiency. The one or more antennas can be adhered to the RF transparent material. Suitable materials include, but are not limited to plastic, wood, glass, stone, cloth, and composites thereof.

The aperture 116 can take a variety of shapes including, but not limited to round, oval, ovoid, square, rectangular, and triangular. The shape of the aperture 116 can be altered to control and tune the antenna's frequency response. For example, changing the aperture 116 from a circle to an oval would load the antenna more resulting in a lower frequency; changing the aperture 116 from a square to a circle would load the antenna less resulting in a higher frequency.

When the antenna panel 120 is engaged with the automobile body panel 110 the surface of an extended portion of the raised body panel mating surface 122 is flush with the exterior surface 112 of the automobile body panel 110 and the lip 124 of the antenna panel 120 fits snugly within an inner wall 118 of the automobile body panel 110. As will be appreciated by those skilled in the art, the aperture 116 in the automobile panel can be circular, as shown, or any other suitable shape including, but not limited to oval, square, rectangular, triangular, octagonal, etc. The shape of the corresponding extended portion of the raised body panel mating surface 122 could also take on the same shape to achieve a flush and smooth surface suitable for detailing (e.g., application of paint or finish).

The thickness of the antenna panel 120 is sufficient to house an antenna 130 within a recess 126 formed in the antenna panel 120. An optional antenna panel cap 140 is configured to engage an interior facing surface 114 of the antenna panel 120 and provide an enclosure for the antenna 130. An optional antenna panel cap 140 can be provided which has an interiorly facing surface 142 and an exteriorly facing surface 144 which, when installed, will face towards an interior of the automobile. A raised wall 146 is provided which is configured to engage the side wall 128 of the antenna panel 120, either on an interior surface or an exterior surface. As will be appreciated by those skilled in the art, the optional antenna panel cap 140 can be secured to the antenna panel 120 using any suitable mechanism including, for example, threads, detents, adhesives, etc.

As will be appreciated by those skilled in the art, a variety of antennas can be positioned within the antenna panel without departing from the scope of the disclosure. For example, a ceramic patch antenna on a rigid PCB can be used. The antennas can be wired, wireless or combinations thereof.

Figure 2:
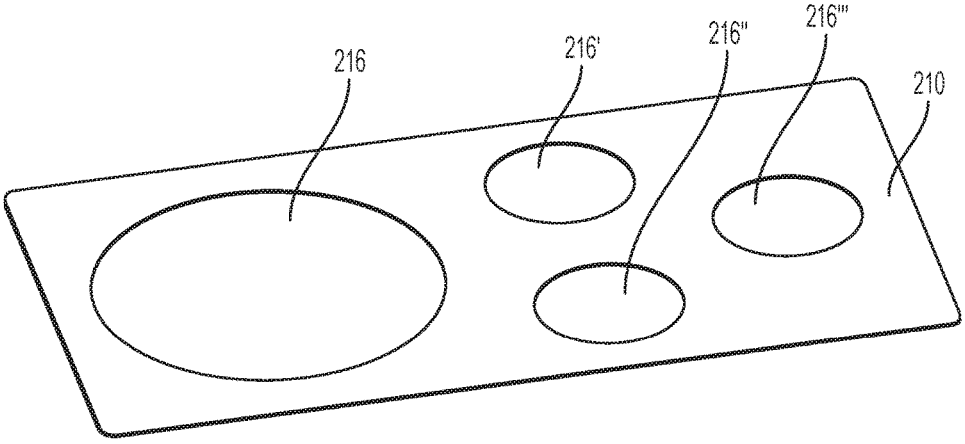
FIGS. 2-5 are views of an antenna system which is configurable to engage multiple antennas.

As shown in FIG. 2 a body panel can have a plurality of apertures 216, 216', 216", 216'". Thus a single body panel for an automobile, for example, can be provided with a plurality of apertures of different sizes to accommodate a plurality of antennas having different characteristics. Each one of the apertures can be configured to engage a separate antenna panel and each one of the apertures can have a different dimension (radius, length, width, etc.) depending on the antenna to be engaged.

Figure 3:
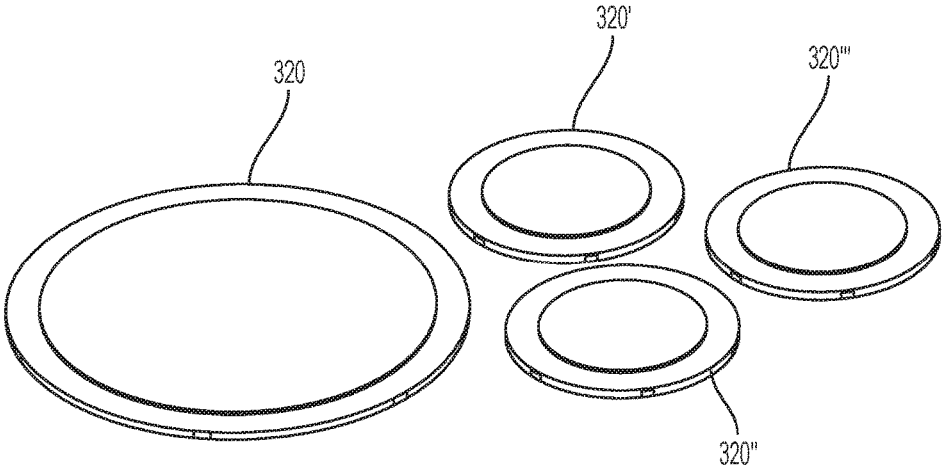
Figure 4:
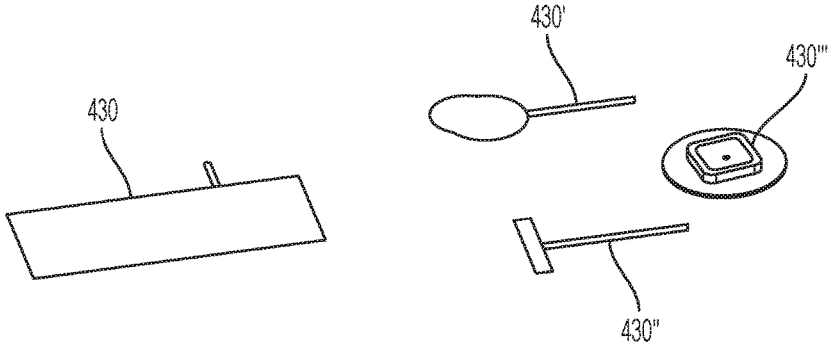
Figure 5:
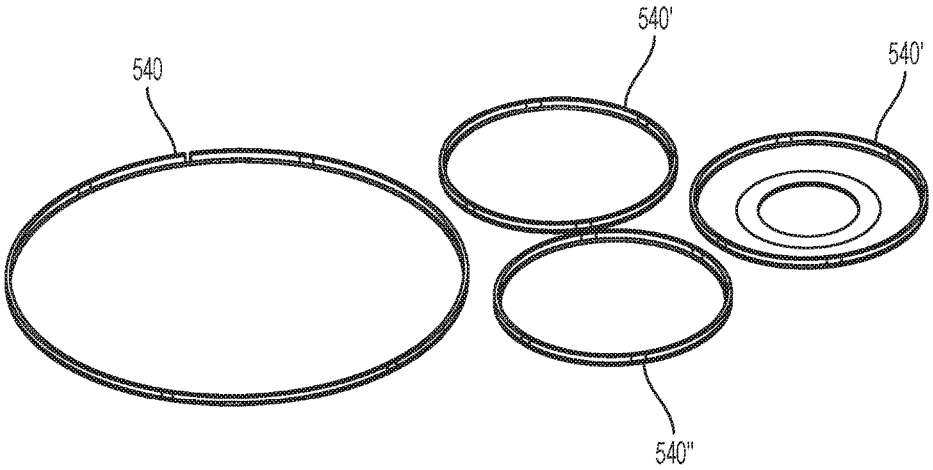

Turning to FIG. 3, the antenna panels 320, 320', 320", 320'" can have different dimensions which are optimized to house an antenna and to fit within an aperture of the body panel. FIG. 4 illustrates various antenna configurations 430, 430', 430", 430'" which can be employed with the antenna panels described above. Lastly, the optional panel caps 540, 540', 540", 540'" shown in FIG. 5 can be sized to engage various sized antenna panels. A variety of seals can be used to protect the interior against the environment, if desirable.

As shown, each antenna can be positioned within its own body panel system and each body panel system can be positioned within a body panel proximate to one or more other antennas. Alternatively, more than one antenna can be positioned within a body panel. In some configurations, the body panels are not positioned proximate one another or positioned on the same body panel. In still other configurations, a plurality of antennas are provided where one or more antenna is positioned within a body panel system, while one or more antennas in the same system are concealed by utilizing, an elongated slot normally functioning only for decoration on a metal panel of the vehicle where the antenna is a slot antenna in which a wire extends across the slot through or behind, for example, an opaque plastic plug fitted in the slot and extending in the plane of the metal panel. Plastic bumper moldings or vehicle trim may be provided that is press-fittable in the slot for retaining the molding or trim in place on the vehicle, and may be a dielectric material to an end of which an antenna element can be fitted.

Incorporating one or more antennas into one or more antenna panels which position the antennas close to the surface of the vehicle body, enables the creation of a cavity behind the antenna with a shape and dimension that is controlled in order to tune the frequency response, efficiency and radiation pattern of each of the one or more antennas. Consequently, modular antenna sets can be created which can be incorporated into a vehicle body panel using any suitable technique. Suitable techniques include conventional vehicle body repair techniques, snap-in, screw-in, adhesion, or other suitable techniques.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A system for incorporating an antenna into a panel comprising:

an aperture positioned within the body panel;

an antenna panel having a first side and a second side with a raised body panel mating surface formed from an RF transparent material with controlled thermal expansion extending from one of the first side and second side wherein the raised body panel mating surface is sized to fit within the aperture in the body panel; and an antenna adhered to the RF transparent material positionable on the antenna panel on an opposing side from the mating panel, wherein at least of an RF characteristic of the RF transparent material and an antenna radiation panel is controllable by a shape of the aperture.

2. The system of claim 1 further comprising an antenna panel cap.

3. The system of claim 1 wherein the shape of the aperture is selected from round, oval, ovoid, square, rectangular, and triangular.

4. The system of claim 1 wherein at least one RF characteristic of the RF transparent material are controlled to tune a frequency response of the antenna.

5. The system of claim 4 wherein the RF characteristic is selected from the group comprising dielectric constant and dielectric loss.

6. The system of claim 1 further comprising one or more additional antennas.

7. The system of claim 1 wherein the antenna panel snap fits the body panel.

8. The system of claim 1 further comprising a plurality of antennas.

9. A method of incorporating an antenna into a body panel comprising:

providing a body panel having an aperture therethrough;

providing an antenna panel having a first side and a second side with a raised body panel mating surface formed from an RF transparent material with controlled thermal expansion extending from one of the first side and second side wherein the raised body panel mating surface is sized to fit within the aperture in the body panel;

adhering the RF transparent material to the antenna pane on an opposing side from the mating panel;

positioning an antenna on the antenna panel on an opposing side from the automobile mating panel;

securing the antenna panel to the body panel; and controlling at least one of an RF characteristic of the RF transparent material and an antenna radiation panel is controllable by a shape of the aperture.

10. The method of claim 9 further comprising the step of installing an antenna panel cap.

11. The method of claim 9 further comprising the step of forming the raised body panel mating surface from an Rh transparent material with controlled thermal expansion.

12. The method of claim 9 further comprising the step of selecting the RF transparent material based on at least one RF characteristic which controls a frequency response of the antenna.

13. The method of claim 9 wherein the step of securing further comprises snap fitting the antenna to the body panel.

14. A system for incorporating an antenna means into a vehicle comprising:

a body panel of the vehicle having an aperture;

an antenna panel means having a first side and a second side with a raised body panel mating surface formed from an RF transparent material with controlled thermal expansion extending from one of the first side and second side wherein the raised body panel mating surface is sized to fit within the aperture in the both panel;

an antenna means positionable on the antenna panel means on an opposing side from the automobile mating panel, wherein at least of an RF characteristic of the RF transparent material and an antenna radiation panel is controlled by a shape of the aperture.

15. The system of claim 14 further comprising an antenna panel cap.

16. The system of claim 14 wherein the shape of the aperture is selected from round, oval, ovoid, square, rectangular, and triangular.

17. The system of claim 14 further comprising one or more additional antenna means.

* * * * *